US009162370B2

(12) United States Patent
Sheng

(10) Patent No.: US 9,162,370 B2
(45) Date of Patent: Oct. 20, 2015

(54) CONCRETE MIXING-AND-TRANSPORT TRUCK WITH A ROTARY SEALED FEED-IN/FEED-OUT PORT OF MIXING DRUM

(75) Inventor: Fuchun Sheng, Shandong (CN)

(73) Assignee: Yantai Shenglida Engineering Technology Co., Ltd. (CN)

( * ) Notice: Subject to any disclaimer, the term of this patent is extended or adjusted under 35 U.S.C. 154(b) by 390 days.

(21) Appl. No.: 13/825,922

(22) PCT Filed: Oct. 21, 2011

(86) PCT No.: PCT/CN2011/001752

§ 371 (c)(1),
(2), (4) Date: Mar. 25, 2013

(87) PCT Pub. No.: WO2012/055161

PCT Pub. Date: May 3, 2012

(65) Prior Publication Data

US 2013/0182525 A1 Jul. 18, 2013

(30) Foreign Application Priority Data

Oct. 30, 2010 (CN) ..... 2010 1 0532751

(51) Int. Cl.
*B28C 5/42* (2006.01)
*B28C 5/08* (2006.01)

(52) U.S. Cl.
CPC ..... *B28C 5/0856* (2013.01); *B28C 5/4262* (2013.01); *B28C 5/4234* (2013.01); *B28C 5/4237* (2013.01)

(58) Field of Classification Search
CPC .... B28C 5/4262; B28C 5/4237; B28C 5/4234
USPC ..... 366/41, 42
See application file for complete search history.

(56) References Cited

U.S. PATENT DOCUMENTS 2,476,023 A * 7/1949 Bohannan ..... 366/41
2,504,223 A * 4/1950 Pasquariello ..... 366/41

(Continued)

FOREIGN PATENT DOCUMENTS

CN 101856989 A 10/2010
CN 101941244 A 1/2011

(Continued)

OTHER PUBLICATIONS

"International Application Serial No. PCT/CN2011/001752, International Preliminary Report on Patentability mailed Apr. 30, 2013", w/English translation, 15 pgs.

(Continued)

*Primary Examiner* — Tony G Soohoo
(74) *Attorney, Agent, or Firm* — Schwegman Lundberg & Woessner, P.A.

(57) ABSTRACT

A concrete mixing-and-transport truck is provided, which comprises a stirring cylinder with a rotary sealed feeding/discharging opening. A annularity sealed cavity is formed between the outer wall of a rotary inner cylinder (15), the inner wall of a fixed outer cylinder (6-2), the back end face of a rotary flange support base (6-1) and the front end face of a sealing end cover (7). At least one sealing belt (13) is set in the annularity rotary sealed cavity. The back end face of the last end sealing belt (13) is contacted tightly with the front end face of the sealing end cover (7). The stirring cylinder and the feeding/discharging opening are connected rotationally by reliable rotary sealing so as to make the stirring cylinder keep rotating when feeding, and reduce the center of gravity of the carrier vehicle. The truck improves driving safety, eliminates concrete de-mixing problem and improves the quality of concrete and architecture quality.

10 Claims, 3 Drawing Sheets

(56) References Cited

U.S. PATENT DOCUMENTS

| | | | | | |
|---|---|---|---|---|---|
| 2,544,083 | A | * | 3/1951 | Hawkins | 366/41 |
| 2,544,084 | A | * | 3/1951 | Hawkins et al. | 366/41 |
| 2,544,545 | A | * | 3/1951 | Rockburg | 366/41 |
| 2,545,485 | A | * | 3/1951 | Meisenburg | 366/41 |
| 2,574,184 | A | | 11/1951 | Jaeger | |

FOREIGN PATENT DOCUMENTS

| | | | |
|---|---|---|---|
| CN | 102029940 | A | 4/2011 |
| CN | 201841604 | U | 5/2011 |
| JP | 57-144715 | A | 9/1982 |
| JP | 2000-33831 | A | 2/2000 |

OTHER PUBLICATIONS

"International Application Serial No. PCT/CN2011/001752, International Search Report mailed Feb. 9, 2012", w/English translation, 8 pgs.

"International Application Serial No. PCT/CN2011/001752, International Written Opinion mailed Feb. 9, 2012", w/English translation, 13 pgs.

* cited by examiner

CONCRETE MIXING-AND-TRANSPORT TRUCK WITH A ROTARY SEALED FEED-IN/FEED-OUT PORT OF MIXING DRUM

RELATED APPLICATIONS

This application is a nationalization under 35 U.S.C. §371 from International Application Serial No. PCT/CN2011/001752, filed Oct. 21, 2011 and published as WO 2012/055161 A1 on May 3, 2012, which claims the priority benefit of Chinese Application Serial No. 201010532751.X, filed Oct. 30, 2010, the contents of which application and publication are incorporated herein by reference in their entirety.

TECHNICAL FIELD

The invention relates to an innovation which is capable of rotary connecting and rotary sealing for a large-scale port in rotary state, particularly to a concrete mixing-and-transport truck with a rotary sealed feed-in/feed-out port of mixing drum utilized this innovation.

TECHNICAL BACKGROUND

In recent years, for less attention paid, the rotary sealing technologies for large-scale rotary equipment are not developed hugely. In known rotary sealing technologies, it is quite difficult for a mixing drum to meet requirements of rotary sealing of its port in rotating state in bad working conditions.

A few of reports mention a mixing-and-transport truck on which a mixing drum is installed horizontally. The feed-in port of the mixing-and-transport truck rotates together with the mixing drum. However, the mixing drum cannot be rotated when feeding materials and the concrete cannot be stirred continuously and accordingly the quality of the concrete cannot be guaranteed. In addition, as the mixing drum cannot be rotated when feeding materials, the concrete will be accumulated near the feed-in port which results in the failure of active feeding.

From prior arts, it cannot lead to rotary sealing of the port for a mixing drum in rotary state. The mixing drums on mixing-and-transport trucks used broadly in the world are still laid in a tilted position at large inclination angles (for example, 15 degree inclination angle). However, there exist the following deficiencies in the prior arts:

1) The tilted position at a large inclination angle causes higher center of gravity. Thus it will increase the risk of overturn accidents due to the unsafe and difficult driving. In fact, the traffic accidents of this kind of vehicles are recurring frequently. Large numbers of reports involved that are published each year.
2) The tilted position at a large inclination angle causes stratification of the concrete in the mixing drum, which will be growing worse as time goes by. The concrete discharged will be heterogeneous and thus the concrete will be stratified when depositing.
3) The fact that the tilted position at a large inclination angle causes higher center of gravity brings about the failure of providing a heating device and because of this, the mixing drum will keep operating in open-air circumstances and the heat will not be retained well. Especially in summers and winters, the concrete is always found disqualified as the temperature cannot meet the required standard.
4) Because the known mixing drum is in open state and no heating device is provided, the phenomenon of "stir-frying cauldron" will be produced where the mixing drum is rotating with heat conduction in the sun shine, and the water in the concrete may be evaporated rapidly. Therefore, when depositing the concrete, the water is required to be supplied again. It will lead to the deteriorated quality and even lost effectiveness of concrete. Therefore, it will be severely restricted not only for the effective time in the mixing drum but also the transportation distance.
5) Because the known mixing drum is in open state, it is easy for hot or cold air, snow or rain to interfuse into the mixing drum, by which the concrete quality will be reduced sharply.
6) Finally, the structure of this equipment grows increasingly obsolete and low automatic.

DISCLOSURE OF THE INVENTION

The purpose of the invention is to provide a concrete mixing-and-transport truck with a rotary sealed feed-in/feed-out port of mixing drum and the following problems will be resolved in the invention:

1) To achieve a reliable rotary sealing for the rotary sealed feed-in/feed-out port of the mixing drum;
2) To actualize an arrangement at a small inclination angle or a horizontal arrangement of the mixing drum;
3) To settle the issue of stratification of the concrete; and,
4) To improve the heat preservation and moisture preservation of the concrete.

The present disclosure provides a concrete mixing-and-transport truck with a rotary sealed feed-in/feed-out port, which comprises a sub-frame and a mixing drum provided with a rotary driving mechanism on the sub-frame. The rotary sealed feed-in/feed-out port is located at the back-end of the mixing drum. It further comprises a rotary inner cylinder, a rotary support body and a sealing end cap, wherein the sealing end cap includes a feeding hopper and a feed-out door, and the sealing end cap is connected to the rotary support body. Following along said rotary sealed feed-in/feed-out port of the mixing drum, the rotary inner cylinder is connected to the back end of said rotary sealed feed-in/feed-out port and the rotary support body is rotatablely supported by the rotary inner cylinder, and at least one sealing belt is provided on the rotary inner cylinder, wherein the back end surface of the backmost of the at least one sealing belt is tightly contacted with the front end surface of the sealing end cap. The rotary support body is installed on the sub-frame.

The invention further discloses the rotary support body includes a rotary flange support seat and a fixed outer cylinder formed on the back end of said rotary flange support seat and the sealing end cap is connected to the back end of the fixed outer cylinder, whereby a looped seal cavity is constituted by the external wall of the rotary inner cylinder, the interior wall of the fixed outer cylinder, the back end surface of the rotary flange support seat and the front end surface of the sealing end cap and, said at least one sealing belt is provided in said looped seal cavity.

The rotary inner cylinder is connected to the rotary sealed feed-in/feed-out port of the mixing drum by a rotary flange.

A fixed flange is installed at the back end of the fixed outer cylinder, and the sealing end cap is connected to the back end of fixed outer cylinder by the fixed flange.

The concrete mixing-and-transport truck with a rotary sealed feed-in/feed-out port further discloses that a fixing stand, to which both ends of the sealing belt are connected or contacted, is provided on the rotary support body and a fixing hole is provided on the fixing stand and further, a mounting rob is provided in the fixing hole, wherein the front end of the mounting rob is mounted on the rotary flange support seat.

Preferably a lubricant container is provided on the fixing stand for lubricating the external wall of the rotary inner cylinder and the sealing belt, of which a lubricant outlet is located above the rotary inner cylinder.

And the rotary flange support seat is contacted with the rotary flange by sliding friction or rolling friction.

Also, a rotary sealing stand is installed on the sub-frame and a fixing support, which is connected with the rotary flange support seat by a bolt, is fixedly installed on the rotary sealing stand, whereby the peripheral surface of the rotary flange keeps noncontact with the rotary flange support seat. Further, a spring is installed on the bolt and the distal end of the spring is press fit above the front end of the fixing frame.

A looped pressure belt, which is inflatable by air filling or water filling, is provided on the outside of the sealing belts. Where the looped pressure belt is enlarged, it tightly presses the sealing belts, which are firmly contacted with the external wall of the rotary inner cylinder, and the space, except the area of the sealing belts in the looped rotary seal cavity is filled up by the enlarged looped pressure belt.

The sealing belt includes air-filling or water-filling chambers, by which the sealing belt is enlarged. The space in the looped rotary seal cavity is filled up by the enlarged sealing belt and, a wear protection layer is further provided on the internal surface of the sealing belt.

Preferably a lubricant container is provided on the fixing stand for lubricating the external wall of the rotary inner cylinder and the sealing belt, of which a lubricant outlet is located above the rotary inner cylinder.

Alternatively the present disclosure further provides a thermal insulating tank, which is installed on the sub-frame and is capable of covering the mixing drum, wherein a heating device, which is connected to the exhaust pipe of the truck, is installed in the thermal insulating tank. Further, a refrigerating device is capable of being provided in the thermal insulating tank.

An awning is also capable of being provided on the sub-frame to cover the upwardside of the mixing drum.

A feed-in door is formed on the feeding hopper, wherein the interior wall of the feed-in door is provided with an atomizing water device.

The beneficial effects provided in the disclosure will be stated as follows:

1) By a reliable rotary sealing, a rotary connection is provided between the mixing drum and a rotary sealing mechanism. Consequently, the mixing drum is capable of rotating even when the material is fed. Also the mixing drum is arranged at a small inclination angle or horizontally, and the gravity centre of the vehicle is moved downward and the driving safety of the concrete mixing-and-transport truck can be improved. Furthermore, the circumstance of concrete stratification is settled effectively and the quality of the concrete together with building quality is increased significantly.

2) By providing the rotary sealing for the feed-in/feed-out port of the mixing drum and an atomizing humidification method, the phenomenon of water evaporation in the mixing drum is eliminated and therefore the moisture preservation in the concrete is improved. Meanwhile the problems of overflow of material, and interfusion of hot or cold air into the mixing drum can be prevented;

3) By providing the thermal insulating tank or awning, the temperature of the concrete can be controlled and accordingly the sunshine issue is resolved;

4) It grows easier to feed and discharge and the working efficiency is increased;

5) The basic Industrial technology is established from the invention for development of largeness of concrete mixing-and-transport truck and vehicle-mounted concrete mixing station as well;

6) The spring is provided on the bolt between the fixing frame and the rotary flange support seat. The distal end of the spring is press fit above the front end of the fixing frame. The configuration, of which the sealing end cap is always keeping firm contact, but not fixedly compactible, with the sealing belt, is capable of fixing the rotary sealing mechanism;

7) By movable connection provided between the rotary sealing stand and the rotary support body, the running of the mixing drum is more stable and dependable;

8) The mixing drum always remains shut-off state during the transportation. Therefore, the harmful effect to the quality of concrete can be overcome by preventing hot or cold air and snow or rain from entering into the mixing drum;

9) By disclosing the lubrication technology between the sealing belt and the rotary inner cylinder, the friction is reduced and then service life is improved; and 10) The disclosure of the invention provides technical basis for promoting the development of concrete mixing-and-transport trucks.

DETAILED DESCRIPTION

Figure 1:
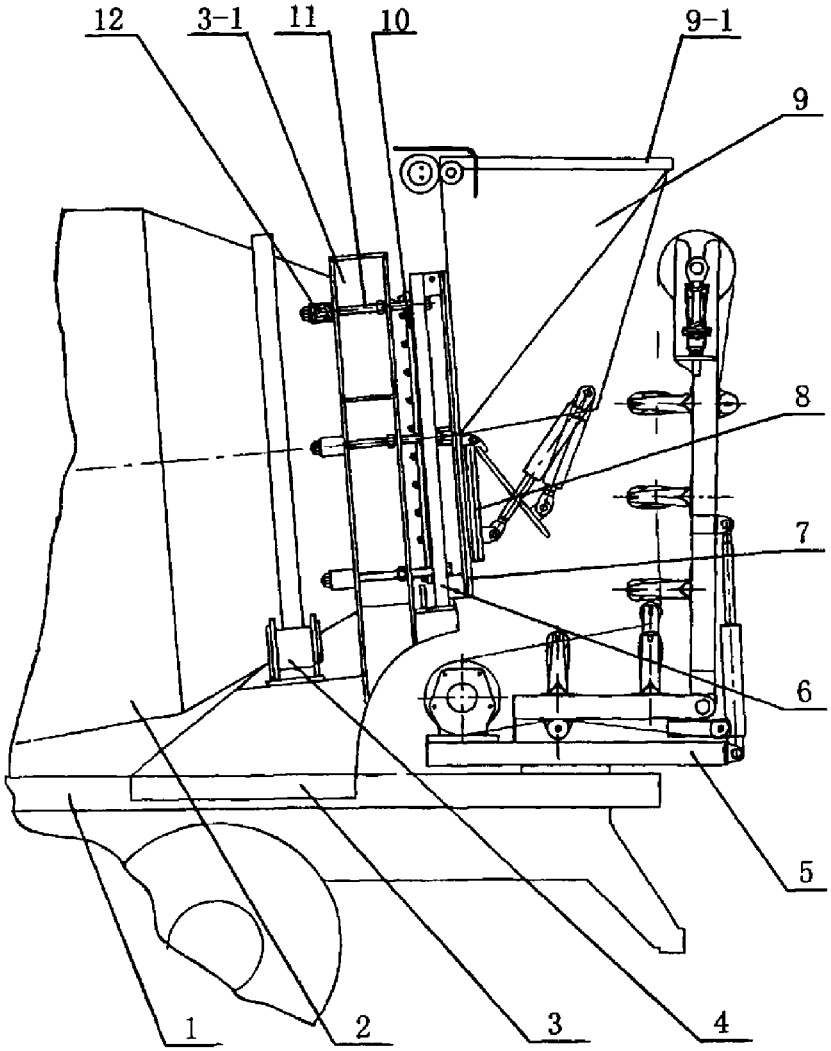
FIG. 1 is a structural diagram for illustrating the invention. The front part of the concrete mixing-and-transport truck, including the rotary driving mechanism of the mixing drum and the chassis part of the truck, is left out in this drawing.

As shown in FIG. 1, the invention discloses a concrete mixing-and-transport truck, including a sub-frame 1 and, a mixing drum 2 with a rotary driving mechanism, which is installed on the sub-frame 1. A feed-in/feed-out port is configured to the back end of the mixing drum 2. On the sub-frame 1, a belt transmission 5 used for feeding out the material is installed. Alternatively, a groove (sluice) mechanism used for feeding out the material can be provided on the sub-frame 1. In other embodiments, a discharging mechanism with pump power can be provided on the sub-frame 1.

A rotary sealing stand 3 is installed on the sub-frame 1, and a rotary support body 6 is capable of being installed on the rotary sealing stand 3 in movable connecting manner such as hinged connection and elastic body connection (for example, a spring), etc. Furthermore, a mixing drum roller 4 is fixed on the rotary sealing stand 3.

Figure 2:
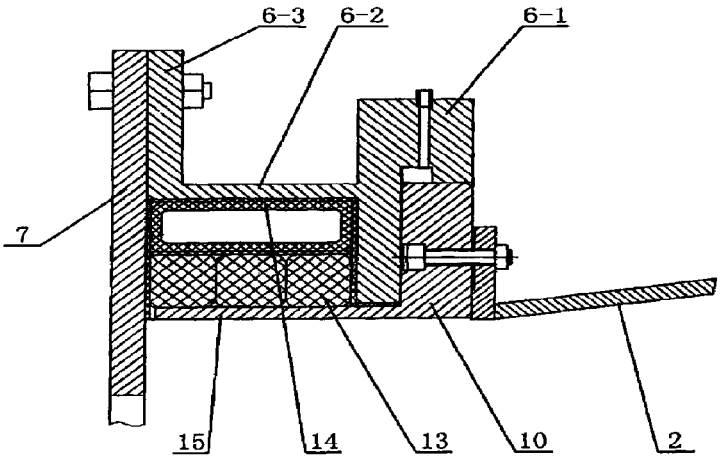
FIG. 2 is a structural diagram for illustrating the first sealing manner used in the looped sealed cavity according to the present disclosure.
Figure 3:
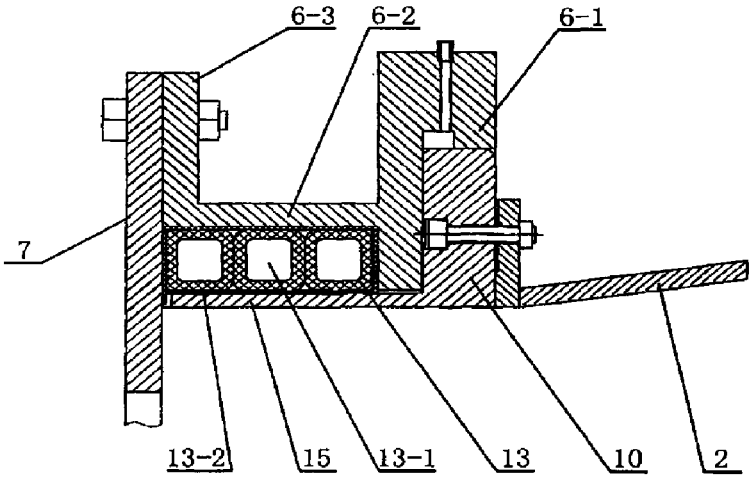
FIG. 3 is a structural diagram for illustrating the second sealing manner used in the looped sealed cavity according to the present disclosure.

As shown in FIGS. 2 and 3, the rotary support body 6 includes a rotary flange support seat 6-1, a fixed outer cylinder 6-2 installed on the back of the rotary flange support seat 6-1, and a fixed flange 6-3 is fitted on the back end of the fixed outer cylinder 6-2. A sealing end cap 7, which includes a feeding hopper 9 and a feed-out door 8, is connected to the back of the fixed flange 6-3. A rotary flange 10 is fixedly connected to the distal end of the mixing drum 2, and a rotary inner cylinder 15 is provided on the back of the rotary flange 10.

A looped seal cavity is constituted by the external wall of the rotary inner cylinder 15, the interior wall of the fixed outer cylinder 6-2, the back end surface of the rotary flange support seat 6-1 and the front end surface of the sealing end cap 7.

The distal end of the rotary inner cylinder 15 is close to the sealing end cap 7 and what's more, a gap, generally 5 mm or less, is formed so as to avoid friction between the distal end of the rotary inner cylinder 15 and sealing end cap 7.

In the looped rotary seal cavity, one or more sealing belts 13 are provided. Wherein, the back end surface of the backmost one of the sealing belts 13 is tightly contacted with the front end surface of the sealing end cap 7.

The following two sealing modes concerning with the looped seal cavity is disclosed.

The first sealing mode is shown in FIG. 2. In the looped seal cavity, a looped pressure belt 14, which is inflatable by air filling or water filling, is provided on the outside of the sealing belts 13. Where the looped pressure belt 14 is enlarged, it is capable of pressing the sealing belts 13 tightly, and therefore, the sealing belts 13 are firmly contacted with the external wall of the rotary inner cylinder 15. At this time, the space, except the area of the sealing belts 13 in the looped rotary seal cavity is filled up by the enlarged looped pressure belt 14.

The second sealing mode is shown in FIG. 3. The sealing belts 13 include air-filling or water-filling chambers 13-1, by which the sealing belts 13 are capable of being enlarged. The space in the looped rotary seal cavity is filled up by the enlarged sealing belts 13. In this case, a wear protection layer 13-2 is provided on the internal surface of the sealing belts 13.

For filling the looped pressure belt 14 or the sealing belts 13 with water or gas, a valve capable of sticking out from the wall of the fixed outer cylinder 6-2 is respectively provided on the looped pressure belt 14 or the sealing belts 13.

Figure 4:
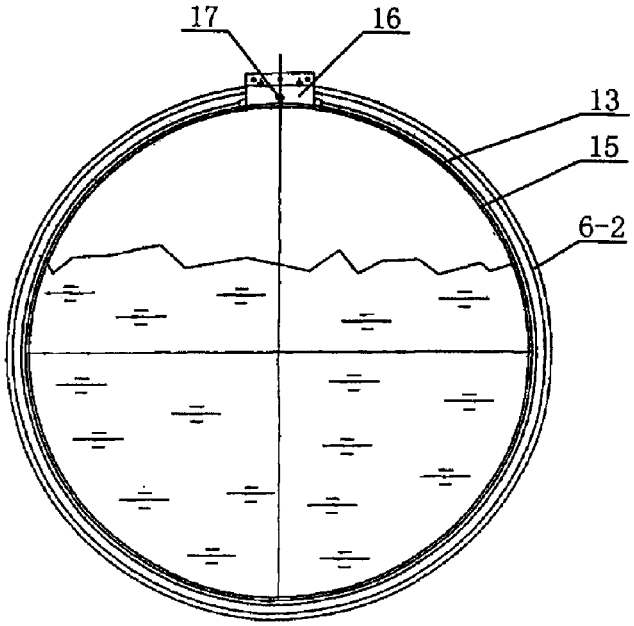
FIG. 4 is a structural diagram for illustrating the fixing stand and the lubrication mechanism used for the sealing belt according to the present disclosure.

As shown in FIG. 4, the ends of each sealing belt 13 are connected to a fixing stand 16, on which a fixing hole is formed. A mounting rob 17 is provided in the fixing hole, wherein the front end of the mounting rob 17 is mounted on the rotary flange support seat 6-1.

For lubricating the external wall of the rotary inner cylinder 15 and the sealing belts 13, a lubricant container is provided on the fixing stand 16, wherein a lubricant outlet of the lubricant container is located above the rotary inner cylinder 15.

The fixing stand 16 is configured for the following purposes. Firstly, it can be used for fixing both ends of the sealing belts 13 to prevent the sealing belt 13 from being rotated with the rotary inner cylinder 15. Secondly, it is provided with a lubricant container for storing the lubricant. In such a mechanism, a port is installed on the top of the fixed outer cylinder 6-2 so as to inlay the fixing stand 16.

A thermal insulating tank is provided on the sub-frame 1 for covering the mixing drum 2. A heating device, which is connected to the exhaust pipe of the truck, is installed in the thermal insulating tank. Further, a refrigerating device is capable of being provided in the thermal insulating tank. In other embodiments, an awning is capable of being provided on the sub-frame 1, in order to cover the upwardside of the mixing drum 2.

The friction between the rotary flange support seat 6-1 and rotary flange 10 can be implemented by sliding or rolling. Wherein, the rolling friction can reduce the friction resistance between the rotary flange support seat 6-1 and the rotary flange 10. Concretely, ball bearings or rollers can be set between the rotary flange support seat 6-1 and the rotary flange 10.

A feed-in door 9-1 is formed on the feeding hopper 9, wherein the interior wall of the feed-in door 9-1 is provided with an atomizing water device, by which sprays are squirted to the inside of the mixing drum 2. Therefore, a moisturizing space can be achieved around the concrete in the mixing drum 2. By this way, the undesirable situation, i.e. water evaporating in the concrete can be controlled and reduced on the premise that the quality of the concrete can be guaranteed.

Figure 5:
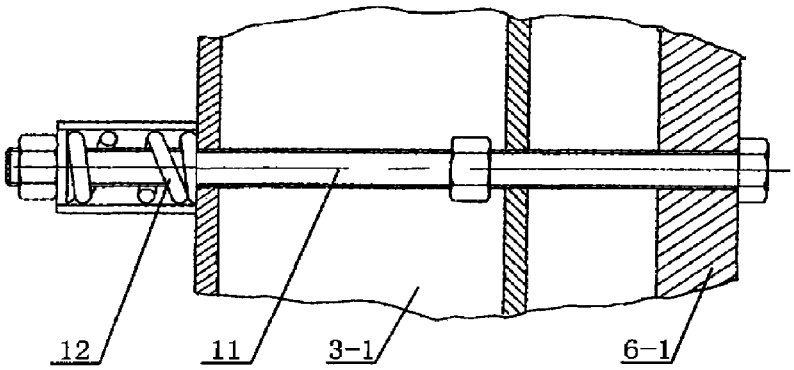
FIG. 5 is a structural diagram for illustrating the spring tension mechanism according to the present disclosure.

As shown in FIG. 1 and FIG. 5, a fixing support 3-1 is fixed on the rotary sealing stand 3 and is fixed to the rotary flange support seat 6-1 by a bolt 11. Wherein, a spring 12 is installed on the bolt 11. The distal end of the spring 12 is press fit above the front end of the fixing frame 3-1. One of the advantages of the configuration is that the sealing end cap always keeps firm contact, but not fixedly compactible with the sealing belts and this is capable of fixing the rotary sealing mechanism.

For the purpose of improving productivity, helical blades are capable of being provided on the inner wall of the rotary inner cylinder 15.

The embodiments disclosed in the invention can be also applied where the feed-in/feed-out port is positioned in the front of the mixing drum 2, i.e., the concrete feed-in/feed-out mechanism is positioned in the front of the mixing drum 2.

INDUSTRIAL APPLICABILITY

By a reliable rotary sealing, a rotary connection can be provided between the mixing drum and a rotary sealing mechanism. Consequently, the mixing drum is capable of rotating even when the material is fed. Also the mixing drum is arranged at a small inclination angle or horizontally, and the gravity centre of the vehicle is moved downward and the driving safety of the concrete mixing-and-transport truck can be improved. Furthermore, the circumstance of concrete stratification is settled effectively and the quality of the concrete together with building quality is increased significantly.

What is claimed is:

1. A concrete mixing-and-transport truck with a rotary sealed feed-in/feed-out port comprising:

a sub-frame;

a mixing drum provided with a rotary driving mechanism on the sub-frame;

the rotary sealed feed-in/feed-out port is located at the back-end of the mixing drum;

wherein, it further comprises a rotary inner cylinder, a rotary support body and a sealing end cap;

said sealing end cap, including a feeding hopper and an feed-out door is connected to the rotary support body;

following along said rotary sealed feed-in/feed-out port of the mixing drum, the rotary inner cylinder is connected to the back end of said rotary sealed feed-in/feed-out port and the rotary support body is rotatably supported by the rotary inner cylinder;

at least one sealing belt is provided on the rotary inner cylinder and the back end surface of the backmost of the sealing belt is adapted to tight contact with the front end surface of the sealing end cap; and, the rotary support body is installed on the sub-frame.

2. The concrete mixing-and-transport truck with a rotary sealed feed-in/feed-out port according to claim 1, wherein the rotary support body includes a rotary flange support seat and a fixed outer cylinder formed on the back end of said rotary flange support seat and the sealing end cap is connected to the back end of the fixed outer cylinder; then a looped seal cavity is constituted by the external wall of the rotary inner cylinder, the interior wall of the fixed outer cylinder, the back end surface of the rotary flange support seat and the front end surface of the sealing end cap and, the sealing belt is located in said looped seal cavity.

3. The concrete mixing-and-transport truck with a rotary sealed feed-in/feed-out port according to claim 2, wherein the rotary inner cylinder is connected to the rotary sealed feed-in/feed-out port of the mixing drum by a rotary flange.

4. The concrete mixing-and-transport truck with a rotary sealed feed-in/feed-out port according to claim 2, wherein a fixed flange is installed at the back end of the fixed outer cylinder and the sealing end cap is connected to the back end of fixed outer cylinder by the fixed flange.

5. The concrete mixing-and-transport truck with a rotary sealed feed-in/feed-out port according to claim 2, wherein a looped pressure belt, which is inflatable by air filling or water filling, is provided on the outside of the sealing belt; being enlarged, the looped pressure belt tightly presses the sealing belt and the sealing belt is accordingly adapted to firm contact with the external wall of the rotary inner cylinder; and the space, except the area of the sealing belt in the looped rotary seal cavity is filled up by the enlarged looped pressure belt.

6. The concrete mixing-and-transport truck with a rotary sealed feed-in/feed-out port according to claim 2, wherein the sealing belt includes air-filling or water-filling chambers, by which the sealing belt is enlarged; and the space in the looped rotary seal cavity is filled up by the enlarged sealing belt and further, a wear protection layer is further provided on the internal surface of the sealing belt.

7. The concrete mixing-and-transport truck with a rotary sealed feed-in/feed-out port according to claim 2, wherein a fixing stand, to which both ends of the sealing belt are connected or contacted, is provided on the rotary support body; and a fixing hole is provided on the fixing stand and further, a mounting rob, the front end of which is mounted on the rotary flange support seat, is provided in the fixing hole.

8. The concrete mixing-and-transport truck with a rotary sealed feed-in/feed-out port according to claim 7, wherein a lubricant container, of which a lubricant outlet is located above the rotary inner cylinder, is further provided on the fixing stand for lubricating the external wall of the rotary inner cylinder and the sealing belt.

9. The concrete mixing-and-transport truck with a rotary sealed feed-in/feed-out port according to claim 3, wherein the rotary flange support seat is contacted with the rotary flange by sliding friction or rolling friction.

10. The concrete mixing-and-transport truck with a rotary sealed feed-in/feed-out port according to claim 3, wherein a rotary sealing stand is installed on the sub-frame; a fixing support, which is connected with the rotary flange support seat by a bolt, is fixedly installed on the rotary sealing stand; and then the peripheral surface of the rotary flange keeps noncontact with the rotary flange support seat and further, a spring is installed on the bolt and the distal end of the spring is press fit above the front end of the fixing frame.

* * * * *